United States Patent [19]

Papas

[11] 4,185,349

[45] Jan. 29, 1980

[54] TOOTHBRUSH CONTOURED TO THE HUMAN MOUTH

[76] Inventor: Sophia Papas, 49 Mellow La., Jericho, N.Y. 11753

[21] Appl. No.: 865,175

[22] Filed: Dec. 28, 1977

Related U.S. Application Data

[63] Continuation of Ser. No. 704,756, Jul. 12, 1976, abandoned.

[51] Int. Cl.[2] ..... A46B 9/04

[52] U.S. Cl. ..... 15/106; 15/167 R

[58] Field of Search ..... 15/167 R, 167 A, 110, 15/143, 106; D4/25-28

[56] References Cited

FOREIGN PATENT DOCUMENTS

| | | | |
|---|---|---|---|
| 920904 | 9/1955 | Fed. Rep. of Germany | 15/167 R |
| 735626 | 8/1932 | France | 15/167 R |
| 1333158 | 6/1963 | France | 15/167 R |
| 1421467 | 11/1965 | France | 15/167R |
| 1554605 | 12/1968 | France | 15/167 R |
| 383322 | 12/1964 | Switzerland | 15/167 R |
| 19408 | of 1896 | United Kingdom | 15/167 R |
| 385238 | 12/1932 | United Kingdom | 15/167 R |
| 471387 | 9/1937 | United Kingdom | 15/167 R |

*Primary Examiner*—Peter Feldman
*Attorney, Agent, or Firm*—Burton S. Heiko

[57] ABSTRACT

A tooth brush having a handle with brush portions on both ends. The handle is contoured in the form of an elongated "S" curve contoured to the curvature of the side rows of human teeth with contoured "bullet shaped" ends to fit the contour of the innermost recesses of the human mouth between its teeth and cheeks.

1 Claim, 4 Drawing Figures

TOOTHBRUSH CONTOURED TO THE HUMAN MOUTH

This application is a continuation of Application Ser. No. 704,756, filed July 12, 1976, now abandoned.

BACKGROUND OF THE INVENTION

The structure of the human mouth is such that the conventional toothbrush now common on the market does not fit properly in the mouth, especially in the back area. It has a straight handle (some may be slightly angled) with bristles on one end only, compelling the user inadvertently to use the bristles twice daily. This procedure does not allow enough drying time between brushings—which can promote bacterial growth. The shape of the handle and tip when brushing, not fitting properly and correctly in the mouth can irritate soft tissue and gums particularly in the third molar area.

THE DRAWINGS

FIG. 1 of the attached drawing shows a side view of a toothbrush designed in accordance with my invention.

DESCRIPTION OF PREFERRED EMBODIMENT

Figure 1:
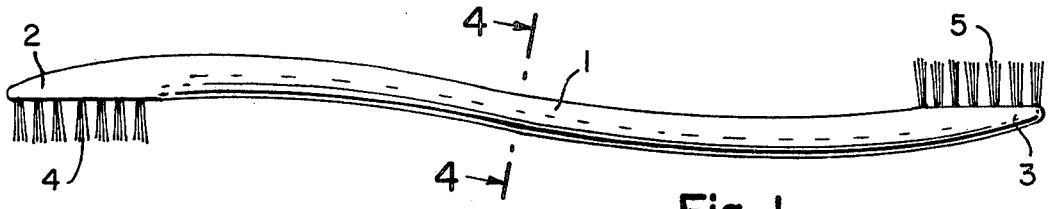
Figure 2:
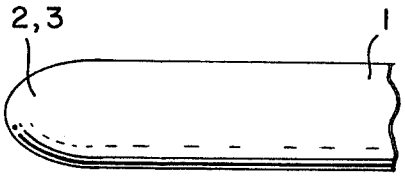
FIG. 2 is a view (at twice the size of FIG. 1 for clarity of illustration) of the ends opposite the bristles.
Figure 3:
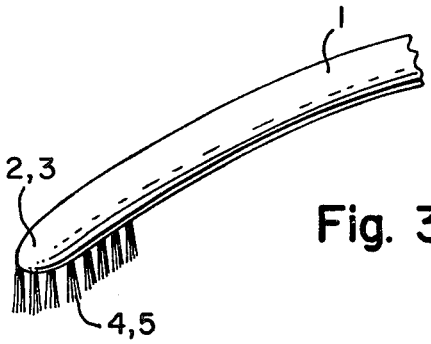
FIG. 3 is a perspective view of the ends of my toothbrush to illustrate better the distinctive "bullet head" or "clam shell head" on the ends which enter the human mouth.
Figure 4:
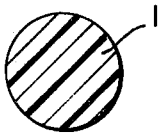
Fig. 4 is a cross section along the line 4—4 of FIG. 1.

FIG. 1 shows a toothbrush about the length of the conventional toothbrush (about seven inches) but in the form of a rather long somewhat flattened "S" curve supporting frame of plastic or other material—the purpose being that the ends of the "S" curve on either side of its middle will fit the curved contour of the human mouth between its side rows of teeth and its cheek tissues smoothly and without irritation when the user grasps handle central portion 1 for the usual tooth brushing operation. The outermost convex surfaces of the "S" contour may be about three quarters of an inch apart, that is in the width of the brush. Both ends 2 and 3 are contoured in a "bullet" or "clam shell" like contour to fit deeply into the innermost recesses of the human mouth between its side teeth and cheeks without tissue injury and to permit the bristles to reach the innermost teeth. As shown in the drawing, each bristle section has a flat base surface equidistantly spaced from the mid-portion of the handle. The flat base surfaces and the mid-portion of the handle are all coplanar. The handle has a constant circular cross-section extending between the inner portions of the flat base surfaces and the maximum width of each bristle section is equal to the lateral width of the handle. Bristles 4 and 5 on the concave side of the "S" curve are the usual brush bristles found on conventional toothbrushes but on both ends to permit adequate drying time for bacterial growth inhibition.

My toothbrush has many important advantages. First, one end of my brush may be used in the morning and the other end may be used at night. This feature will allow each set of bristles 4 and 5 to dry for twenty four hours or more to inhibit bacterial growth which would otherwise occur more readily on a single ended brush used twice a day. The shape of my brush will enable it to extend deeper into the back area between the cheeks and the last tooth for more efficient cleansing. Being completely round cross sectionally for most of its length, it ensures a safer and gentler manipulation during toothbrushing without injuring or irritating soft gums or tissues. Thus the design of my toothbrush is such that it will hug the teeth without much pressure being applied which otherwise might be necessary in brushing the teeth. Thus there are less chances of the brush slipping and injuring soft tissues. Thirdly, the "bullet" tip or "clam shell" shaped heads are designed to reach the back of the mouth where the mouth's structural shape requires this type of adaptation. This enables that extra penetration so essential for the hard to reach third molars. Fourthly, the brush is more economical for the user—he or she buys two brushes for the price of one. It takes up less space than two separate brushes.

I claim:

1. a toothbrush comprising a flattened "s" shaped handle having oppositely directed sections on the ends of said handle, said handle having parallel convex and concave curved surfaces along said handle extending to said bristle sections, each bristle section having a flat base surface extending from the end of the concave surface to the outer end of each bristle section, said bristle sections being equidistantly spaced from the mid-portion of said handle, said flat base surfaces being coplanar with each other and with the mid-portion of said handle, said handle having a constant circular cross-section extending between said flat base surfaces, the outer ends of each bristle section having a hemispheric shaped surface which converges to a bullet shaped tip portion, the maximum width of each bristle section in the lateral direction being equal to the lateral width of said handle, whereby, when inserted into the natural curvature of the mouth, between the cheeks and rows of teeth from the beginning of the oral cavity to its inner molars, the cheeks are forced up, over, and around said bullet shaped tip and hermispheric shaped surface and the bristles hugg the curvature of the teeth by the counter pressure of the cheeks against said bullet shaped bristle section.

* * * * *